United States Patent [19]

Sato et al.

[11] Patent Number: 4,865,664

[45] Date of Patent: Sep. 12, 1989

[54] AMORPHOUS ALLOY STRIPS HAVING A LARGE THICKNESS AND METHOD FOR PRODUCING THE SAME

[75] Inventors: Takashi Sato; Tsutomu Ozawa; Toshio Yamada, all of Kawasaki, Japan

[73] Assignee: Nippon Steel Corporation, Tokyo, Japan

[21] Appl. No.: 102,274

[22] Filed: Sep. 28, 1987

Related U.S. Application Data

[60] Continuation of Ser. No. 797,176, Nov. 8, 1985, abandoned, which is a division of Ser. No. 672,065, Nov. 16, 1984, abandoned.

[30] Foreign Application Priority Data

| | | | |
|---|---|---|---|
| Nov. 18, 1983 | [JP] | Japan | 58-216287 |
| Feb. 25, 1984 | [JP] | Japan | 59-33335 |
| May 31, 1984 | [JP] | Japan | 59-112015 |

[51] Int. Cl.[4] ..... C22C 38/00

[52] U.S. Cl. ..... 148/403; 148/304; 428/606; 428/607

[58] Field of Search ..... 148/403, 304; 428/606, 428/607

[56] References Cited

U.S. PATENT DOCUMENTS

| | | | |
|---|---|---|---|
| 3,354,937 | 11/1967 | Jackson | 164/87 |
| 4,231,816 | 11/1980 | Cuomo et al. | 148/403 |
| 4,288,260 | 9/1981 | Senno et al. | 148/121 |
| 4,307,771 | 12/1981 | Draizen et al. | 164/463 |
| 4,314,594 | 2/1982 | Pfeifer et al. | 148/108 |
| 4,331,739 | 5/1982 | Narasimhan | 428/606 |
| 4,450,206 | 5/1984 | Ames et al. | 148/31.55 |
| 4,469,536 | 9/1984 | Forester | 75/128 B |

FOREIGN PATENT DOCUMENTS

| | | | |
|---|---|---|---|
| 88244 | 9/1983 | European Pat. Off. | 148/31.55 |
| 55-18582 | 2/1980 | Japan . | |

OTHER PUBLICATIONS

Liebermann et al, "Dependence of Some Properties on Thickness of Smooth Amorphous Alloy Ribbon", J. Appl. Phys., 55(6), Mar. 15, 1984, pp. 1787–1789.

IEEE, vol. MAG-18, No. 6, Nov. 1982, pp. 1385–1387.

*Primary Examiner*—John P. Sheehan

*Attorney, Agent, or Firm*—Kenyon & Kenyon

[57] ABSTRACT

An iron base amorphous alloy strip having a sheet thickness of from 50 to 150 μm and a sheet width of at least 20 mm. The strip is produced by a single-roll cooling process and has a fracture strain of 0.01 or more.

10 Claims, 9 Drawing Sheets

AMORPHOUS ALLOY STRIPS HAVING A LARGE THICKNESS AND METHOD FOR PRODUCING THE SAME

This application is a continuation of application Ser. No. 797,176 filed Nov. 8, 1985, now abandoned, which in turn is a divisional of application Ser. No. 672,065 filed Nov. 16, 1984, now abandoned.

BACKGROUND OF THE INVENTION (1) Field of the Invention

The present invention relates to amorphous alloy strips having a large thickness and a method for producing the same, more particularly to amorphous alloy strips having a large thickness produced by quenching and solidifying molten metal or alloy on a movable cooling substrate and a method for the same.

(2) Description of the Related Art

It is well known to use a melt spin process to continuously produce amorphous strips from molten metal or alloy. In the melt spin process, molten metal is deposited onto a cooling substrate, e.g., the surface of annular chill roll, through a nozzle or nozzles. The molten metal is quenched and solidified by the cooling substrate, resulting in a continuous metal strip or wire.

In the melt spin process, the cooling rate is so high that, if the composition is suitably selected, an amorphous metal or alloy having substantially the same structure as the molten metal can be obtained. An amorphous metal or alloy has unique properties valuable for practical applications.

There are, however, some difficulties in obtaining wide strips. Important factors in the production of an amorphous metal or alloy are the shape of the nozzle, the relative arrangement of the nozzle and cooling substrate, the ejecting pressure of the molten metal through the nozzle, and the moving rate of the cooling substrate. To increase the width of the strip, one must meet severe conditions for each of the above.

A continuous casting method for a metallic amorphous strip and an apparatus for producing a wide strip are disclosed in Japanese Unexamined Patent Publication (Kokai) No. 53-53525. The method includes the steps of directing a slotted nozzle having a rectangular opening to a cooling substrate (roll or belt) with a gap of from about 0.03 to about 1 mm therebetween, advancing the cooling substrate at a speed to provide a peripheral velocity of from about 100 to about 2000 meters per minute, and ejecting molten metal to the chill surface of the cooling substrate through the slotted nozzle. The molten metal is quenched in contact with the chill surface at a rapid quenching rate and solidifies into a continuous amorphous metal strip. In this method, there is no limit on the width of the amorphous metal strip, in principle.

Restrictions on the cooling rate also make it difficult to obtain a thick strip. The problem of thickness of increasing the thickness of the strip has not been solved up until now. This limit on the thickness of the strip applies not only to amorphous metal requiring severe cooling conditions, but also to crystalline metal not requiring the same. The principal method adoptable to try to form a metal strip having a large thickness in the conventional continuous molten metal quenching process is to increase the advancing length of the puddle formed on the cooling substrate with respect to the advancing speed of the cooling substrate. In actual production of an amorphous metal strip, any one of the following means or combinations thereof may be considered to achieve this increase: The means are 1. To enlarge the width of the nozzle opening
2. To increase the forcing pressure
3. To increase the gap between the nozzle and the chill surface
4. To decrease the advancing speed of the cooling substrate The present inventors experiments to produce an amorphous metal strip having a large thickness by using the above four means, but could not obtain good results. They found that there is a limit on thickness due to the type of metal or alloy and the material of the cooling substrate and that an unreasonable increase in thickness leads to an undesired shape and deterioration of the strip. Excessive molten metal, specifically, adheres to the nozzle and solidifies thereon. The solidified metal, which contacts the advancing chill surface, leads to nozzle breakage. Also, when a thick strip is produced by the above four means, the free surface of the metal strip is exposed to the atmosphere for a longer time, resulting in an undesired appearance, such as a rough surface, furrows, and coloring. Generation of such phenomena, in the case of an amorphous alloy, means also that crystal is formed on the surface layer, even if the crystal cannot be detected by X-ray diffraction. This reduces the ductility, the magnetic properties such as coercive force and core loss, and other properties of the amorphous alloy.

IEEE Trans., May 18 (1982) page 1385, discloses that if the strip thickness at which the coercive force begins to increase is defined as the critical strip thickness at which crystallization commences, the greatest critical strip thickness shown by an Fe-Si-B system alloy is 42 μm of $Fe_{76}$-$B_{10}$-$Si_{10}$. According to investigations by the present inventors, with $Fe_{80.5}Si_{6.5}B_{12}Cl$ of a width of 25 mm, the critical strip thickness is 32 μm. Further U.S. Pat. No. 4,331,739 discloses $Fe_{40}Ni_{40}P_{14}B_6$ of a width of 5 cm, a thickness of 0.05 mm (50 μm), and isotropic tensile properties.

Recently, an Fe base alloy strip having a width of 25.4 mm and a thickness of 82 μm was reported (Journal of Applied Physics vol. 5, No. 6 (1984) P. 1787). According to the report, however, this alloy strip, of $Fe_{80}B_{14.5}Si_{3.5}C_2$ showed the existence of 5% or less crystals under an X-ray diffraction test. As a consequence, the alloy strip as cast shows considerable brittleness. The fracture strain by bending stress of an 82 μm thick $Fe_{80}B_{14.5}Si_{3.5}C_2$ alloy is 0.006. The fracture strain $\epsilon_f$ is usually represented by the equation $\epsilon_f = t/(2r-t)$, wherein t is the strip thickness and r is the bending radius.

The more amorphous the alloy, the greater the fracture strain. A substantially amorphous alloy has a crystallization ratio of 1% or less as cast. The crystallization ratio is defined as follows:

$$Fc = (I - Io)/Ic$$

wherein I is the diffraction intensity on a specified crystal face for example (110) face of a sample of a strip as cast, Io is the diffraction intensity on the same crystal face of a standard amorphous sample, and Ic is the diffraction intensity on the same crystal face upon complete crystallization.

SUMMARY OF THE INVENTION

The main object of the invention is to provide an Fe base alloy strip having a large sheet thickness and width.

Another object of the present invention is to provide an Fe base alloy strip having a large sheet thickness and width and having improved mechanical properties, particularly, bending fracture strain.

A further object of the present invention is to provide a method for producing an amorphous metal strip having a large sheet thickness and width and having improved properties.

According to the present invention, there is provided an Fe base amorphous alloy strip having a sheet thickness of from 50 to 150 μm and a sheet width of at least 20 mm. The strip is produced by depositing molten metal onto the surface of a moving annular chill body in what is called a "Single-roll cooling process". This strip preferably has a surface roughness of the free surface and the constrained surface to the roll below 0.5 mm when measured by Japan Industrial Standard (JIS)-B0601. It also preferably has a fracture strain $\epsilon_f$ of 0.01 or more. In the present invention, "free surface" is defined as the strip surface which is not directly contacted with the chill surface of the roll during the production of amorphous strips. On the other hand, "constrained surfact to the roll" is defined as the strip surface which is in direct contact with the chill surface of the roll.

There is further provided a method for producing an amorphous metal strip by jetting a molten metal onto a chill surface of a rotating annular chill body for quenching, including the steps of drawing out a first molten metal on the moving chill surface through a first molten metal puddle portion to make a first strip; drawing out a second molten metal over the first strip as in a not completely solidified state of through a second molten metal puddle portion so as to make a second strip, the first strip being brought into strong contacted with the moving chill surface due to the pressure generated by the second puddle portion; and drawing out subsequent molten metals through further portions so as to make subsequent strips until the required sheet thickness is obtained. The resultant strip is a monolithic state strip.

DESCRIPTION OF THE PREFERRED EMBODIMENTS

Figure 1:
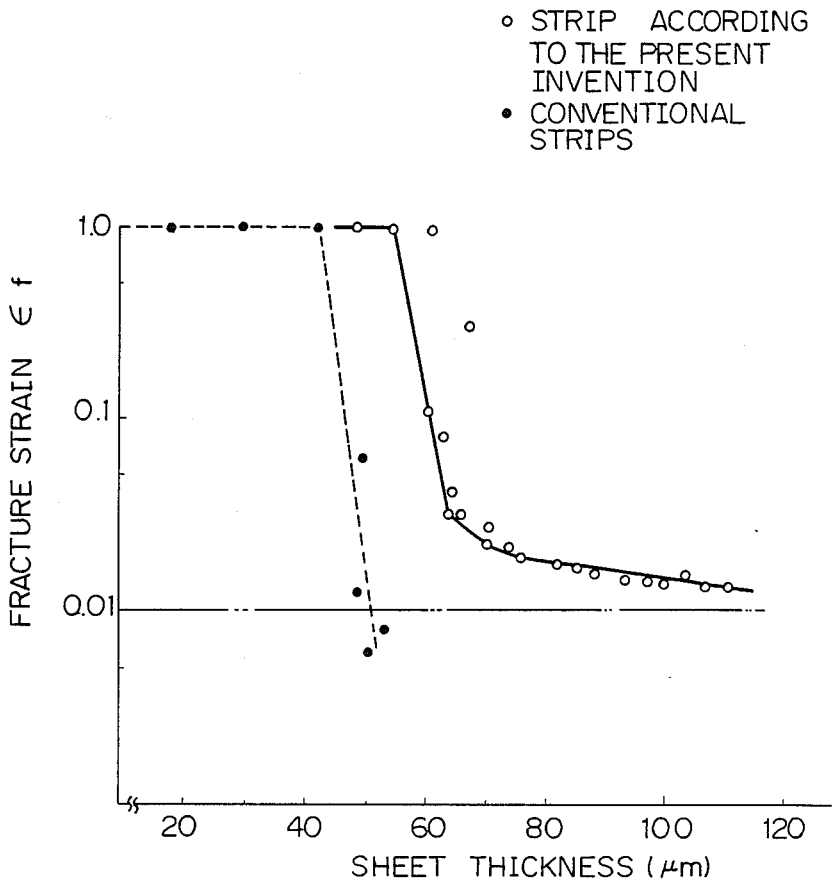
FIG. 1 is a graph illustrating the relationship between strip thickness and fracture strain in amorphous alloy strips according to the present invention and that of conventional alloy strips.

The Fe base amorphous alloy strip according to the present invention has a smoother constrained surface and free surface compared with a strip produced by a conventional process. As shown in Table 1, the center-line average surface roughness Ra at a cut off value of 0.8 mm measured by JIS B0601 is below 0.5 μm for both the constrained surface and free surface. This is smaller, i.e., superior, compared with the 0.6 to 1.3 μm of a conventional constrained surface and the 0.6 to 1.5 μm of a conventional free surface.

With respect to the relationship between the surface roughness and magnetic properties, a smoother surface roughness means an improved coercive force, magnetic flux density and space factor. On the other hand, a thicker strip can be used for a large transformer as like a siliconsteel sheet and can be easily handled without deterioration of magnetic properties.

For example, since the amorphous alloy strip according to the present invention has a large thickness and smooth surface, the space factor is very high. The space factor of a conventional amorphous alloy strip having thinner thickness ranges from 75% to 85%, while, the space factor of an amorphous alloy strip according to the present invention ranges from 85% to 95%. Use of a material having a high space factor for, e.g., a magnetic core enables realization of a smaller core. Thus, a material having a high space factor is advantageous in practical use.

Even though the amorphous alloy strip of the present invention has a large thickness, no deterioration of its properties occur. The alloy strip remains substantially amorphous therethrough and so maintains its specific amorphous properties. For example, while a magnetic flux density at 50 Hz and 1 Oe of 1.53 tesla can be obtained in a conventional amorphous alloy strip of $Fe_{80.5}B_{12}C_1$ (at %) having a thickness of 25 μm and a width of 25 mm, the same magnetic flux density can be obtained in an amorphous alloy strip of $Fe_{80.5}Si_6$ having a thickness of 65 μm and a width of 25 mm according to the present invention. It is clear that no deterioration in magnetic flux density occurs.

The Fe base amorphous alloy strip by which the second object can be obtained is at least 50 μm thick, at least 20 mm wide, and has a bending fracture strain ($\epsilon_f$) of 0.01 or more, generally 0.15 or more, as mentioned above. On the other hand, the bending fracture strain $\epsilon_f$ in a conventional strip having the same thickness is below 0.01. Thus, the strip of the present invention has a 50% larger fracture strain than a conventional strip.

The reason why the strip of the present invention has improved mechanical properties will be hereinafter explained.

It is well known that the properties of an amorphous alloy strip depend on the sheet thickness. The sheet thickness of the strip will change the properties through thermal hysteresis. The decrease of the fracture strain which arises with an increase of the sheet thickness derives from the slower cooling rate of the strip during and after solidification. The slower cooling rate occurs as the sheet thickness of the strip become larger. Namely, when the thickness of the strip become larger, the amorphous structure of the strip is relaxed so that the structure of the strip becomes crystal, whereby the strip becomes brittle.

From this point of view, the strips of the present invention are produced so that the cooling rate is not decreased. In the present invention, although the sheet thickness of the strip is enlarged, the cooling rate during and after solidification is substantially the same phenomena as in the case of conventional strips having a sheet thickness of 30 μm. Therefore, the time during which the strips of the present invention are relaxed becomes short, with the result that they have improved mechanical properties, particularly, a large bending fracture strain.

FIG. 1 is a graph illustrating the relationship between sheet thicknesses and fracture strain in amorphous alloy strips according to the present invention and that of conventional alloy strips. The amorphous alloy strips used consist of $Fe_{80.5}Si_{6.5}B_{12}C_1$.

As shown in FIG. 1, when the sheet thickness of conventional strips exceeds 45 μm, the fracture strain $\epsilon_f$ rapidly declines. When the sheet thickness is 50 μm, the fracture strain is about 0.01. However, in the strips of the present invention, when the sheet thickness of the strips is 55 μm, the fracture strain is 1. Namely, even if the strips of the present invention are bent at an angle of 180°, they will not fracture. In the case of a sheet thickness of 65 μm, 180° bending is impossible, but a fracture strain of 0.03 is obtained. In the case of a sheet thickness of 75 μm, the fracture strain declines to 0.02. However, even in the case of a sheet thickness of 110 μm, the fracture strain is above 0.01.

Figure 2:
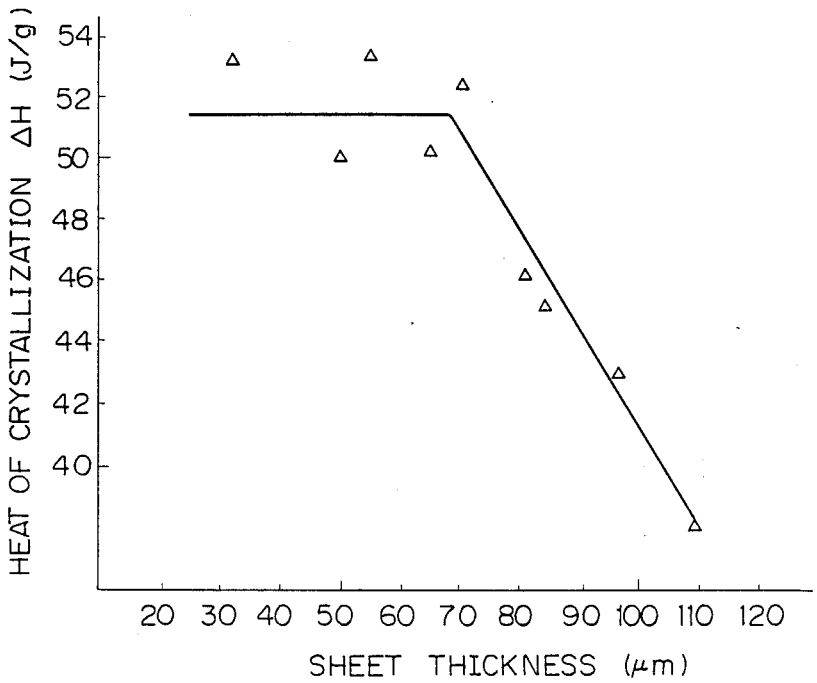
FIGS. 2 and 3 are graphs illustrating the relationships between strip thicknesses and heat of crystallization and between strip thicknesses and magnetic flux density.
Figure 3:
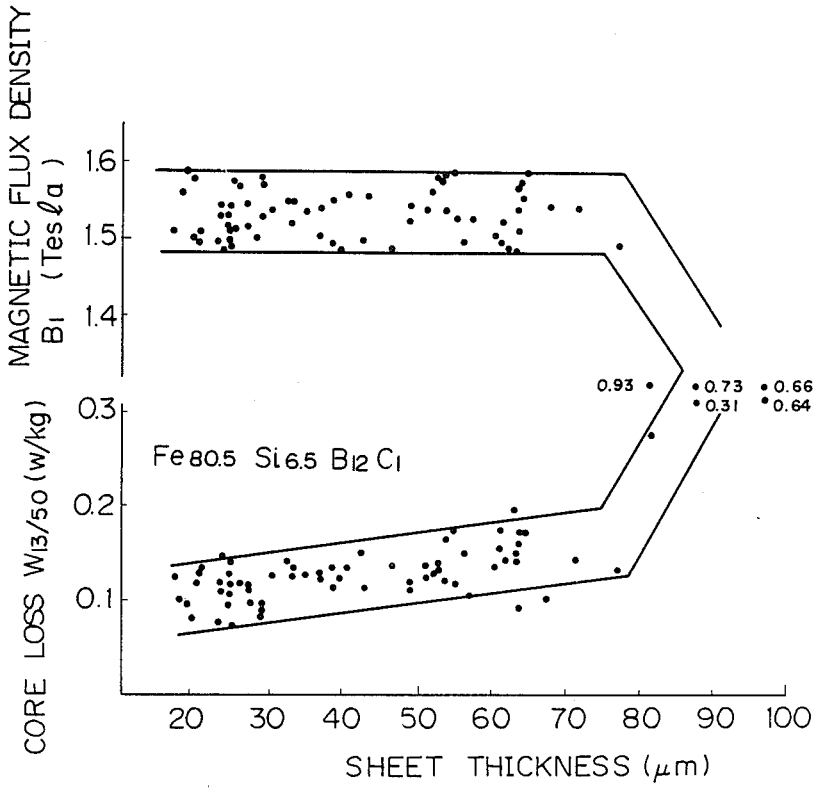

FIGS. 2 and 3 are graphs illustrating the relationships between strip thicknesses and heat of crystallization and between strip thicknesses and magnetic flux density.

As shown in FIG. 2, in an amorphous alloy strip of the present invention consisting of $Fe_{80.5}Si_{6.5}B_{12}C_1$, the heat of crystallization ΔH (J/g) is constant in cases of sheet thicknesses ranging from 20 μm to 70 μm. When the sheet thickness exceeds 70 μm, the heat of crystallization is rapidly lowered. On the other hand, as shown in FIG. 2 (not shown) in the above-mentioned Journal of Applied Physics, the heat of crystallization is rapidly lowered at a sheet thickness of about 17 μm. This means that the amorphous substance ratio of the strip of the present invention is higher than that of a conventional strip in a wide range of sheet thicknesses.

Further, as shown in FIG. 3, in a strip of the present invention having a sheet thickness below about 70 μm, the core loss $W_{13/50}$ (W/kg) is larger than that of a conventional strip of about 20 to 30 μm. However the magnetic properties, for example, the magnetic flux density, in a strip of the present invention is substantially the same as in a conventional strip. We core loss increases due to the increase of the domain width, not to occurrence of crystals.

The amorphous alloy strip of the present invention includes Fe as a main component and includes one or more of boron, silicon, carbon, phosphorus, and the like as a metalloid. In accordance with the properties required, part of the iron may be substituted by another metal. For example, if a magnetic property is required, half the iron may be replaced with cobalt and/or nickel. In turn, in order to improve the magnetic property, one or more of molybdenum, niobium, manganese, and tin may be added. In order to improve corrosion resistance, one or more of molybdenum, chromium, titanium, zirconium, vanadium, hafnium, tantalum, and tungsten may be added. In order to improve mechanical properties, manganese, aluminum, copper, tin, or the like may be added. The content of iron may range from 40% to 82% (at %), boron from 8% to 17%, silicon from 1% to 15%, carbon below 3%, and residual elements below 10% in total. Above ranges of respective composition are selected in accordance with use.

With the amorphous alloy strips of the present invention are used as a core material, the strips are preferably composed of $Fe_aB_bSi_cC_d$. The ranges of a, b, c, and d are respectively 77 to 82, 8 to 15, 4 to 15, and 0 to 3.

The amorphous alloy strips according to the present invention are advantageously used for transformers, spring materials, corrosion resistant materials, sensors, structural materials, and the like.

A method for producing an amorphous alloy strip according to the present invention will now be explained in detail with reference to the drawings.

Figure 4:
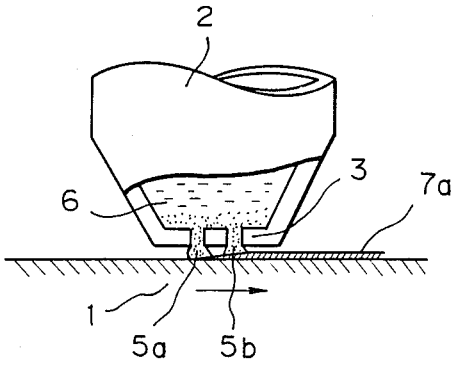
FIG. 4 is a view explaining a method according to the present invention.
Figure 5:
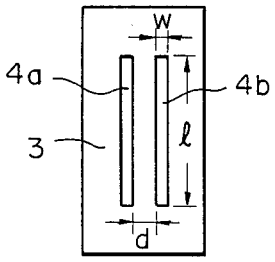
FIGS. 5 and 6 are views explaining nozzles used in a method according to the present invention.
Figure 6:
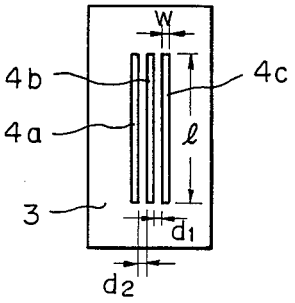
Figure 7:
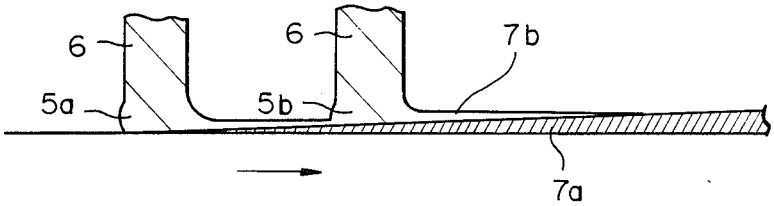
FIG. 7 is a view illustrating a method for producing a strip according to the present invention.

FIG. 4 is a view explaining the method according to the present invention, FIGS. 5 and 6 are views explaining nozzles used in the method, and FIG. 7 is another view illustrating the method according to the present invention.

As shown in FIGS. 4 and 5, a metal substance in usually melted by using a crucible 2. After that, molten metal 6 is flowed out on a cooling substrate 1, which moves in the direction of the arrow, through openings 4*a* and 4*b* of a nozzle 3.

As shown in FIG. 7, a puddle 5*b* composed of molten metal 6 flowed out through the second opening 4*b* is formed on an incompletely solidified strip 7*a* drawn out from a puddle 5*a* flowed out through the first opening 4*a* and formed on the cooling substrate 1. The strip 7*b* made of the puddle 5*b* is moved to the strip 7*a*. Since the strip 7*a* has sufficient cooling ability, the strip 7*b* is rapidly cooled together with the strip 7*a*, whereupon a monolithic sheet formed by the strips 7*b* and 7*a* is obtained.

As a result, strips having a large thickness can be continuously produced.

According to the present invention, the flowing out of the molten metal on the chill surface is preferably carried out under a pressurized atmosphere of, for example, 0.5 to 2 kg/cm$^2$ larger pressure than ambient pressure ambient pressure. This pressure increases the contact force of the molten metal with the chill surface.

In the present method, at the stage of commencement of the solidification of metal, the molten metal contacts with the cooling substrate with a thermal effect. The cooling rate of the strip in the range of temperature most important for the properties of the strip is remarkably increased, enabling formation of a strip having twice or more the sheet thickness of strips produced by the conventional method.

According to the present invention, when, for example, multiple openings of nozzles are used, the opportunities for oxidation of the free surface of the strips and crystallization of the strips are considerably decreased.

Thus, an amorphous alloy strip having a large sheet thickness according to the present invention does not suffer from deterioration of properties or undesired shape.

In the present invention, it is preferable that the atmosphere around the puddle be inert gas such as helium.

The gap between one puddle and a subsequent puddle may be selected so that when the strip portion formed via the one puddle contacts the strip portion formed via the subsequent puddle the former has not yet completely solidified. The most suitable gap is usually 4 mm or less. The width direction of the opening of the nozzle is oriented in parallel to the moving direction of the cooling substrate.

The size of the opening and the gap between openings may be selected as follows.

Length (1) of opening: Substantially the same as the width of strips

Width (w) of opening: Maximum 0.8 mm Minimum about 0.2 mm

Distance (d) between openings: determined in accordance with shape and size of the opening and required sheet thickness; usually 0.5 to 4 mm.

To increase the sheet thickness of the strip, a plurality of openings having a small width may be used while keeping the gap between the openings small.

The present inventors have found that there is a certain range of sheet thickness in which strips having improved shapes and properties can be formed by a certain number of openings. For strips consisting of iron and metalloid, the range is 15 to 45 μm for a single opening of a width of 0.4 mm; 30 to 60 μm for two openings; and 40 to 70 μm for three openings. These sheet thicknesses can be further increased by increasing the ejecting pressure during the casting.

Using this method, therefore, there should be no limit as to the sheet thickness in principle. However, there is an actual limit on the sheet thickness of the strips produced by the present invention due to the thermal conductivity and critical cooling rate of amorphous material. Still, the upper limit of the sheet thickness is remarkably raised as compared to the conventional method.

EXAMPLE 1

Figure 8:
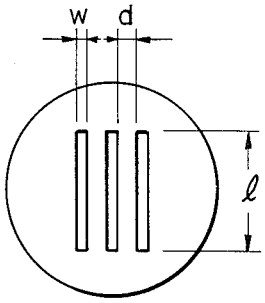
FIG. 8 is a view of a bottom surface of a nozzle with nozzle openings used in the present invention.

Alloys consisting of compositions described in Table 1 were cast in an amorphous alloy strip having a width of 25 mm by using a single roll made of copper and using three-slotted nozzles (w: 0.4 mm, 1: 25 mm, d: 1 mm) as shown in FIG. 8. The production controls were an ejecting pressure of molten metal of 0.20 to 0.35 kg/cm$^2$, a roll speed of 20 to 28 m/sec, and a gap between the nozzle and roll of 0.15 to 0.25 mm.

The sheet thickness, surface roughness, and space factor of the obtained amorphous alloy strips of the various compositions are shown in Table 1. Also shown are the typical levels of conventional strips produced by using a single roll. As shown in Table 1, in the strips of the present invention, the sheet thickness is large, the surface roughness small, and the space factor high compared to conventional strips.

Figure 9A:
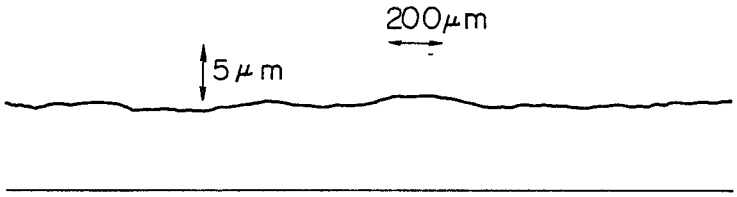
FIGS. 9A and 9B are views illustrating the surface roughness of a free surface and constrained surface of an amorphous alloy strip according to the present invention.
Figure 9B:
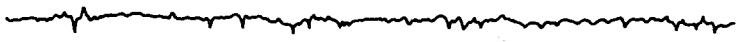
Figure 9C:
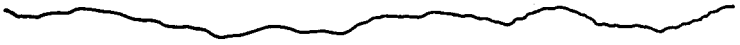
FIGS. 9C and 9D are views illustrating the surface roughness of a free surface and constrained surface of comparative alloy strips.
Figure 9D:
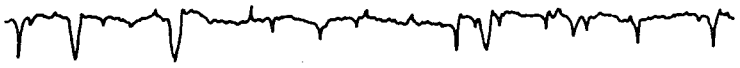

FIGS. 9A and 9B are views illustrating the surface roughness of a free surface and a constrained surface of an amorphous alloy strip according to the present invention. FIGS. 9C and 9D are views illustrating the surface roughness of a free surface and a constrained surface of comparative alloy strips. The amorphous alloy strip of the present invention has a sheet thickness of 62 μm, while the comparative alloy strip has a sheet thickness of 40 μm.

Figure 10B:
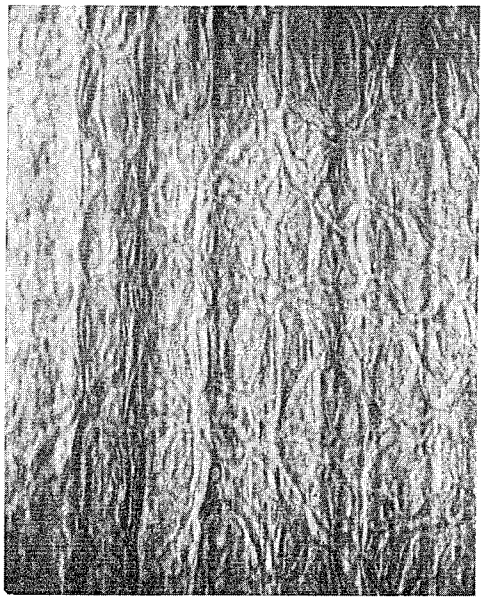
FIGS. 10A and 10B are scanning electron micrographs illustrating a magnetic domain structure of a free surface of an amorphous alloy strip as cast according to the present invention and a conventional alloy strip.
Figure 10A:
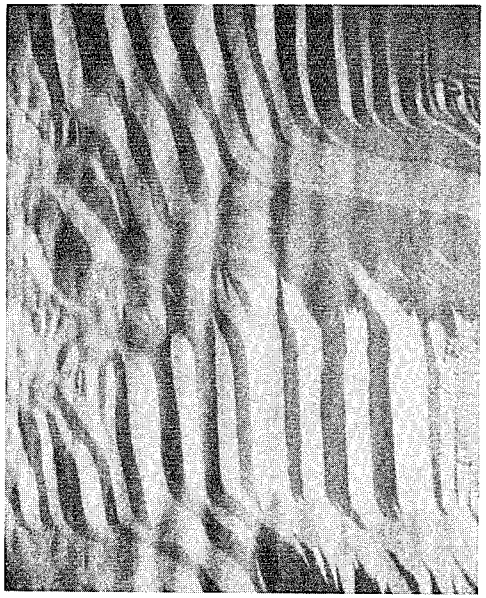

FIGS. 10A and 10B are scanning electron micrographs illustrating the magnetic domain structure of a free surface of amorphous alloy strip No. 1 in Table 1 according to the present invention and a conventional alloy strip. The conventional alloy strip has a complex maze pattern of a magnetic domain structure, while the alloy strip of the present invention has, as cast, 180° magnetic domains oriented in the same direction.

Figure 11B:
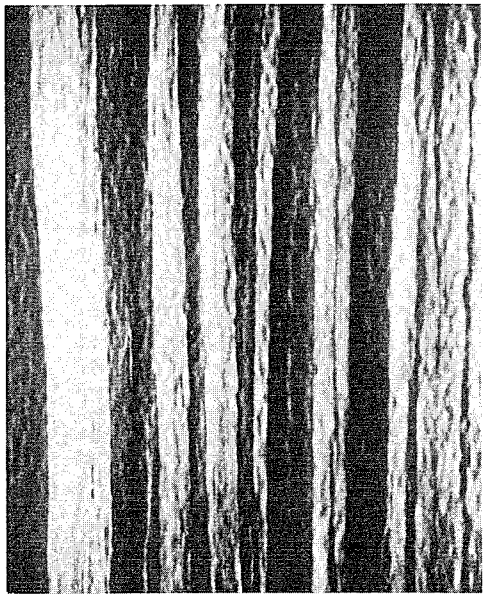
FIGS. 11A and 11B are scanning electron micrographs illustrating a magnetic domain structure of a free surface, after annealing, of an amorphous alloy strip according to the present invention and a conventional alloy strip.
Figure 11A:
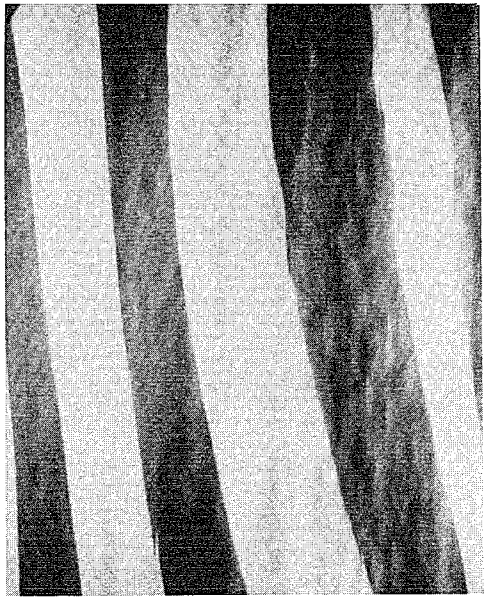

FIGS. 11A and 11B are scanning electron micrographs illustrating the magnetic domain structure of a free surface, after annealing, of an amorphous alloy strip according to the present invention and a conventional alloy strip. The amorphous alloy strip according to the present invention shown in FIG. 11A has a magnetic domain of a larger width than in the conventional alloy strip shown in FIG. 11B.

EXAMPLE 2

Alloys consisting of compositions described in Table 2 were cast into amorphous alloy strips having a width of 25 mm by using the same single roll, nozzle, and production conditions as explained in Example 1.

The sheet thickness, surface roughness, and space factor of the obtained amorphous alloy strips of the various compositions are shown in Table 2.

As explained in Example 1, the alloy strips according to the present invention have improved properties.

TABLE 1

| | No. | Composition (at %) | Sheet thickness μm | Surface roughness Ra (μm) Constrained surface | Surface roughness Ra (μm) Free surface | Space factor (%) | $B_1$ (T) |
|---|---|---|---|---|---|---|---|
| Strips of the present invention | 1 | $Fe_{80.5}B_{12}Si_{7.5}$ | 62 | 0.41 | 0.44 | 90 | 1.52 |
| | 2 | $Fe_{80.5}B_{12}Si_{6.5}C_1$ | 65 | 0.38 | 0.41 | 91 | 1.53 |
| | 3 | $Fe_{78}B_{10}Si_{12}$ | 60 | 0.38 | 0.40 | 88 | 1.49 |
| | 4 | $Fe_{78}B_{10}Si_{10}C_2$ | 62 | 0.29 | 0.38 | 90 | 1.50 |
| | 5 | $Fe_{70.5}B_{12}Si_{7.5}Co_{10}$ | 65 | 0.38 | 0.40 | 91 | 1.61 |
| | 6 | $Fe_{70.5}B_{12}Si_{7.5}Ni_{10}$ | 68 | 0.35 | 0.38 | 92 | 1.40 |
| | 7 | $Fe_{75.5}B_{12}Si_{7.5}Mo_5$ | 71 | 0.40 | 0.46 | 92 | 0.97 |
| | 8 | $Fe_{75.5}B_{12}Si_{7.5}Cr_5$ | 69 | 0.37 | 0.42 | 88 | 1.03 |
| | 9 | $Fe_{75.5}B_{12}Si_{7.5}Nb_5$ | 70 | 0.30 | 0.39 | 90 | 1.05 |
| | 10 | $Fe_{65.5}B_{12}Si_{7.5}Co_{10}Mo_5$ | 72 | 0.39 | 0.37 | 93 | 1.05 |
| | 11 | $Fe_{65.5}B_{12}Si_{7.5}Ni_{10}Mo_5$ | 70 | 0.33 | 0.37 | 92 | 0.93 |
| | 12 | $Fe_{65.5}B_{12}Si_{7.5}Ni_{10}Cr_5$ | 66 | 0.25 | 0.32 | 90 | 0.90 |
| | 13 | $Fe_{65.5}B_{12}Si_{7.5}Co_{10}Cr_5$ | 57 | 0.36 | 0.40 | 90 | 1.03 |
| | 14 | $Fe_{60.5}B_{12}Si_{7.5}Ni_5Co_{10}Cr_5$ | 55 | 0.38 | 0.46 | 89 | 1.01 |
| Comparative strips | 15 | $Fe_{80.5}B_{12}Si_{7.5}$ | 36 | 0.81 | 0.60 | 84 | 1.52 |

TABLE 1-continued

| No. | Composition (at %) | Sheet thickness μm | Surface roughness Ra (μm) Constrained surface | Free surface | Space factor (%) | $B_1$ (T) |
|---|---|---|---|---|---|---|
| 16 | $Fe_{80.5}B_{12}Si_{6.5}C_1$ | 40 | 0.75 | 0.93 | 83 | 1.53 |
| 17 | $Fe_{78}B_{10}Si_{12}$ | 23 | 0.64 | 0.63 | 83 | 1.48 |

$B_1$: Magnetic flux density in 50 Hz, 1 Oe
Ra: Cutoff value 0.8 mm, measured length 8 mm
Space factor: About 700 g strip was wound up on a reel having outer diameter of 40 mm.

$$\text{Space factor} = \frac{\text{Measured weight}}{\text{Calculated weight}}$$

Wherein the calculated weight is $(R^2 - r^2)\pi w\rho$
R: outer diameter of ring
r: inner diameter of ring
w: width
ρ: specific weight

TABLE 2

| | No. | Composition (at %) | Sheet thickness μm | Surface roughness Ra (μm) Constrained surface | Free surface | Space factor (%) |
|---|---|---|---|---|---|---|
| Strips of the present invention | 1 | $Fe_{80}P_{13}C_7$ | 65 | 0.39 | 0.41 | 91 |
| | 2 | $Fe_{72}P_{13}C_7Cr_8$ | 62 | 0.45 | 0.44 | 90 |
| | 3 | $Fe_{70}P_{10}C_{10}Cr_{10}$ | 59 | 0.38 | 0.38 | 94 |
| | 4 | $Fe_{50}P_{13}B_7Ni_{30}$ | 67 | 0.48 | 0.42 | 90 |
| | 5 | $Fe_{50}P_{13}B_7Co_{30}$ | 70 | 0.32 | 0.37 | 93 |
| | 6 | $Fe_{76}P_{13}C_3Si_4Cr_4$ | 62 | 0.41 | 0.39 | 91 |
| Comparative strips | 7 | $Fe_{80}P_{13}C_7$ | 28 | 0.68 | 0.61 | 84 |
| | 8 | $Fe_{80}P_{13}C_7$ | 33 | 0.78 | 0.87 | 82 |
| | 9 | $Fe_{80}P_{13}C_7$ | 41 | 0.81 | 0.90 | 81 |

EXAMPLE 3

An alloy consisting of $Fe_{80.5}Si_{6.5}B_{12}C_1$ (at %) was cast into an amorphous alloy strip by using substantially the same production conditions explained in Example 1.

The sheet thickness, bending fracture strain $\epsilon_f$, and other properties are shown in Table 3. Also shown are the properties of Co conventional alloy strip produced by using a single-slotted nozzle (d: 0.7 mm, l: 25 mm).

TABLE 3

| | Sheet thickness (μm) | $\epsilon_f$ | Ra (μm) Roll surface | Free surface | Space Factor (%) |
|---|---|---|---|---|---|
| Strip of the present invention | 65 | 0.03 | 0.35 | 0.40 | 91 |
| Comparative strip | 50 | 0.0065 | 0.80 | 1.05 | 83 |

EXAMPLE 4

An alloy consisting of $Fe_{80.5}B_{12}C_1$ was cast into an amorphous alloy strip by using a single roll and a four-slotted nozzle (w: 0.4 mn, l: 25 mm, d: 1 mm) and an ejecting pressure of molten metal of 0.3 kg/cm$^2$. During the casting, the roll speed was changed from 25 m/sec to 18 m/sec. At the time the roll speed was changed, the free surface of the strip was pressurized by helium gas. A comparative strip was also cast by using the same nozzle as explained in Example 3. The roll speed was also changed as mentioned above.

The obtained properties are shown in Table 4.

TABLE 4

| | Sheet thickness (μm) | $\epsilon_f$ | Ra (μm) Roll surface | Free surface | Space factor (%) |
|---|---|---|---|---|---|
| Strip of according to the present invention | 75 | 0.02 | 0.32 | 0.35 | 93 |
| Comparative strip | 56 | 0.005 | 0.82 | 1.13 | 85 |

EXAMPLE 5

An alloy consisting of $Fe_{80.5}Si_{6.5}B_{12}C_1$ was also cast into an amorphous alloy strip by using the two-slotted nozzle as shown in FIG. 5 (1: 25 mm, w: 0.4 mm, d: 1 mm) and a single roll made of copper. The production controls were an ejecting pressure of molten metal of 0.22 kg/cm$^2$, a roll speed of 25 m/sec, and a gap between the nozzle and roll of 0.15 mm. The sheet thicknesses of the obtained strips were an average 45 μm. Further crystallization was not found in the strips by X-ray diffractometry. The magnetic properties of the strip according to the present invention are substantially the same as those of a conventional strip produced by using a single nozzle, as shown in Table 5.

TABLE 5

| Sheet thickness (μm) | Core loss $W_{1.3/50}$ (Watt/kg) | Magnetic flux density $B_1$ (Tesla) |
|---|---|---|
| 35 | 0.23 | 1.32 |
| 26 | 0.10 | 1.51 |
| 45 | 0.11 | 1.52 |

(Heat treatment: 380° C. × 1 hr)

EXAMPLE 6

An alloy consisting of $Fe80.5Si_{6.5}B_{12}C_1$ was cast into an amorphous alloy strip by using a three-slotted nozzle as shown in FIG. 6 (l: 25 mm, w: 0.4 mm, $d_1=d_2$: 1.0 mm ) and a single roll. The production conditions were the same as explained in Example 5. The sheet thickness of the obtained strips was an average 60 μm. Further, non-crystallization was found in the strips. The magnetic properties, shown in Table 6, are substantially the same as the strips produced by the conventional method.

TABLE 6

| Sheet thickness (μm) | Core loss $W_{1.3/50}$ (Watt/kg) | Magnetic flux density $B_1$ (Tesla) |
|---|---|---|
| 62 | 0.125 | 1.53 |

EXAMPLE 7

An alloy consisting of 6.5 wt % silicon steel was cast into an amorphous alloy strip by using a three-slotted nozzle as shown in FIG. 6 (l: 25 mm, w: 0.4 mm, $d_1=d_2$: 1.5 mm) and a single roll made of iron. The production conditions were an ejecting pressure of molten metal of 0.22 kg/cm$^2$, a roll speed of 22 m/sec, and a gap between the nozzle and the roll of 0.2 mm. The sheet thickness and the crystal grain size of the obtained strips were an average 63 μm and 10 μm, respectively. The surface property and the shape of the strip were remarkably improved.

EXAMPLE 8

An amorphous stainless steel strip consisting of $C_{0.06}Si_{0.6}Mn_{0.5}P_{0.025}S_{0.005}$ (wt %) was produced by using a single roll made of iron and the nozzle in Example 7. The production conditions were the same as explained in Example 7.

The sheet thickness and the crystal grain size were an average 58 μm and 5 μm, respectively. The properties were improved.

EXAMPLE 9

An amorphous alloy strip consisting of $Fe_{80}Mo_4B_{12}C_4$ (at %) was produced by using a four-slotted nozzle (l: 25 mm, w: 0.4 mm, d: 1.0 mm). The production conditions were a first ejecting pressure of molten metal of 0.08 kg/cm$^2$, a second ejecting pressure of 0.22, a roll speed of 12 m/sec, and a gap between the nozzle and the roll of 0.15 to 0.18 mm.

The sheet thickness of the obtained strip was an average 100 μm. The strips were found to be amorphous by X-ray diffractometry.

Figure 12A:
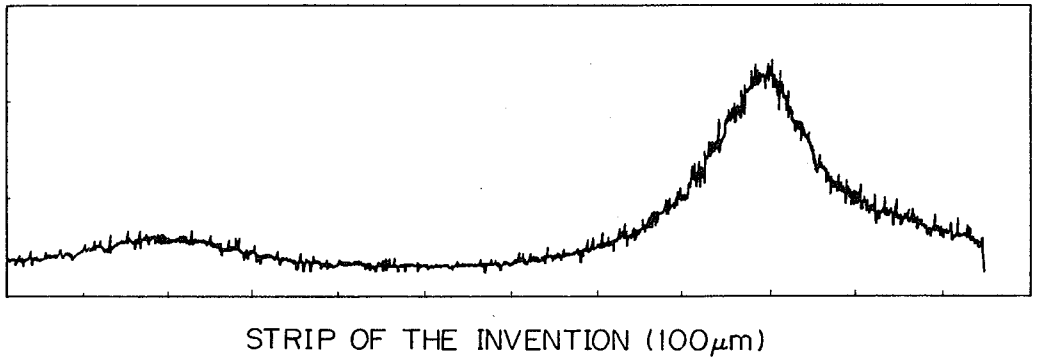
FIGS. 12A and 12B are views illustrating the X-ray diffraction intensity of an amorphous strip having a thickness of 100 μm according to the present invention and a conventional strip having a thickness of 30 μm.

FIGS. 12A and 13 are views illustrating the X-ray diffraction intensity of an amorphous strip having a thickness of 100 μm according to the present invention and a conventional strip having a thickness of 30 μm.

Figure 12B:
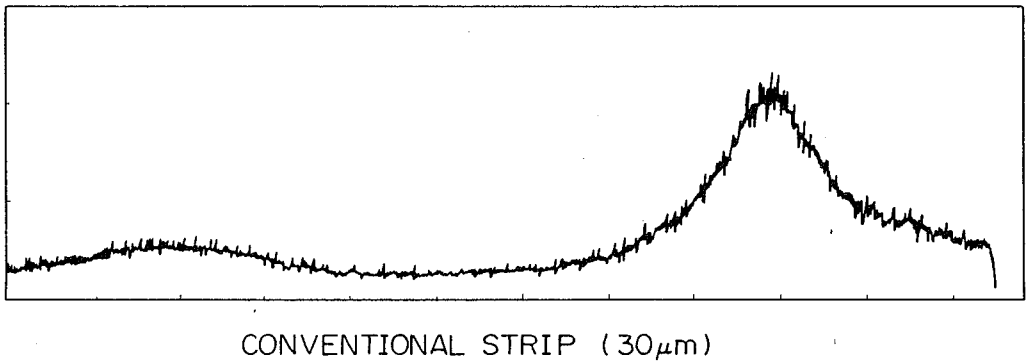

It can be seen from FIGS. 12 and 13 that the X-ray diffraction intensity of the strip of the present invention is substantially the same as that of a conventional strip.

EXAMPLE 10

An amorphous alloy strip consisting of $Fe_{80}Mo_4B_{12}C_4$ (at %) was produced by using a four-slotted nozzle (1: 25 mm, w: 0.4 mm, d: 1.0 mm). The production conditions were a first ejecting pressure of molten metal of 0.08 kg/cm$^2$, a second ejecting pressure of 0.28,kg/cm$^2$, a roll speed of 12 m/sec, and a gap between the nozzle and the roll of 0.15 to 0.18 mm.

The sheet thickness of the obtained strip was an average 120 μm. The strips were found to be amorphous by X-ray diffractometry. The X-ray diffraction intensity was substantially the same as that of the Example 9.

We claim:

1. An iron base amorphous alloy strip having a sheet thickness of from 50 to 150 μm and a sheet width of at least 20 mm and having a fracture strain of 0.01 or more, said strip being produced by a single-roll cooling process, wherein said strip is produced by ejecting a molten metal on a surface of a moving cooling substrate for quenching, comprising the steps of:

providing a nozzle having a plurality of spaced-apart slotted openings positioned adjacent to the cooling substrate wherein the spacing between adjacent slotted openings in the direction of movement of the cooling substrate is not more than 4 mm.;

drawing out a first molten metal on the moving cooling substrate through a first molten metal puddle portion to make a first strip;

drawing out a second molten metal having the same composition as the first molten metal on the first strip in a not completely solidified strip through a second molten metal puddle portion so as to make a monolithic strip composed of the second metal and the first strip, the first strip being brought in strong contact with the moving chill surface of rotating annular chill body due to pressure generated by the second puddle portion; and drawing out one or more subsequent molten metals each having the same composition as the first molten metal through further molten metal puddle portions to make subsequent monolithic strip until the required sheet thickness is obtained.

2. An iron base amorphous alloy strip produced by a single-roll cooling process according to claim 1, wherein said first, second, and subsequent molten metals are ejected form respective openings of a nozzle.

3. An iron base amorphous alloy strip produced by a single-roll cooling process according to claim 1, wherein a distance between the openings of a nozzle having a rectangular shape is from 0.5 to 4 mm.

4. An iron base amorphous alloy strip produced by a single-roll cooling process according to claim 1, wherein said drawing out of the molten metal is carried out in a pressurized atmosphere.

5. An iron base amorphous alloy strip produced by a single-roll cooling process according to claim 1, wherein said drawing out of the molten metal is carried out by increasing an ejecting pressure thereof during the method.

6. An iron base amorphous alloy strip produced by a single-roll cooling process according to claim 1, wherein the gap between said molten metal puddle portions is 4 mm of less.

7. An iron base amorphous alloy strip produced by a single-roll cooling process according to claim 1, wherein said strip comprises, in atomic percent, 40% to 82% Fe, 8% to 17% B, 1% to 15% Si, 0 to 3% C and residual elements below 10% in total, and has a crystallization ratio of 1% of less.

8. An iron base amorphous alloy strip produced by a single-roll cooling process according to claim I, wherein said strip has a property of a surface roughness of a free surface and a roll surface being below 0.5 μm when measured by Japan Industrial Standard (JIS)-B0601.

9. An iron base amorphous alloy strip produced by single-roll cooling process according to claim 7, wherein said strip has a property of a surface roughness of a free surface and a roll surface being below 0.5 μm when measured by Japan Industrial Standard (JIS)-B0601.

10. An iron based amorphous alloy strip produced by a single-roll cooling process according to claim 1, wherein said strip has a thickness of at least 60 μm.

* * * * *

UNITED STATES PATENT AND TRADEMARK OFFICE

CERTIFICATE OF CORRECTION

PATENT NO. : 4,865,664

DATED : September 12, 1989

INVENTOR(S) : T. SATO, et al.

It is certified that error appears in the above-identified patent and that said Letters Patent is hereby corrected as shown below:

Column 2, line 38, change " Cl of a width" to --$C_1$ of a width--.

Column 3, line 28, change "surfact" to --surface--.

Column 3, line 39, change "contacted" to --contact--.

Column 4, line 52, change "$Fe_{80.5}B_{12}C_1$" to --$Fe_{80.5}Si_{6.5}B_{12}C_1$--.

Column 4, line 54, change "$Fe_{80.5}Si_6$" to --$Fe_{80.5}Si_{6.5}$--.

Column 5, lines 8 and 9, in each of these lines change "become" to --becomes--.

Column 5, line 63, change "We" to --The--.

Column 6, line 17, change "With" to --When--.

Column 6, line 19, "preferably composed..." should continue on after "the strips are" in line 18, and not start a new paragraph.

UNITED STATES PATENT AND TRADEMARK OFFICE

CERTIFICATE OF CORRECTION

PATENT NO. : 4,865,664

DATED : September 12, 1989

INVENTOR(S) : T. SATO, et al.

It is certified that error appears in the above-identified patent and that said Letters Patent is hereby corrected as shown below:

Column 6, line 34, change "a metal substance in" to --a metal substance is--.

Column 6, line 55, after "pressure" insert a period and delete "ambient pressure".

Column 9, line 57, change "$Fe_{80.5}B_{12}C_1$" to --$Fe_{80.5}Si_{6.5}B_{12}C_1$--.

Column 10, line 48, "(1: 25 mm.", 1 should not be in bold type.

Column 12, line 35, change "strip" to --strips--.

Column 13, line 4, before "single-roll" insert --a--.

Signed and Sealed this

Tenth Day of December, 1991

*Attest:*

HARRY F. MANBECK, JR.

*Attesting Officer*

*Commissioner of Patents and Trademarks*